US008673116B2

(12) United States Patent
Konishi et al.

(10) Patent No.: US 8,673,116 B2
(45) Date of Patent: Mar. 18, 2014

(54) WATER DISINTEGRATABLE FIBROUS SHEET

(75) Inventors: Takayoshi Konishi, Kanonji (JP); Kazuya Okada, Kanonji (JP); Jyoji Shimizu, Kanonji (JP)

(73) Assignee: Unicharm Corporation, Shikokuchuo-Shi, Ehime (JP)

( * ) Notice: Subject to any disclaimer, the term of this patent is extended or adjusted under 35 U.S.C. 154(b) by 67 days.

(21) Appl. No.: 13/376,899

(22) PCT Filed: Jun. 8, 2010

(86) PCT No.: PCT/JP2010/060005

§ 371 (c)(1),
(2), (4) Date: Dec. 8, 2011

(87) PCT Pub. No.: WO2010/143736

PCT Pub. Date: Dec. 16, 2010

(65) Prior Publication Data

US 2012/0080155 A1 Apr. 5, 2012

(30) Foreign Application Priority Data

Jun. 11, 2009 (JP) ..... 2009-140474

(51) Int. Cl.
*D21H 13/08* (2006.01)

(52) U.S. Cl.
USPC ..... 162/157.7; 162/109; 162/115; 162/141; 162/146; 162/157.1; 442/408; 428/323; 428/326; 428/327; 428/332; 428/364; 428/401

(58) Field of Classification Search
USPC ..... 162/109, 114, 115, 141, 146, 149, 162/157.1, 157.6, 157.7; 428/221, 323, 428/326, 357, 364, 401, 292.1, 332; 442/408
See application file for complete search history.

(56) References Cited

U.S. PATENT DOCUMENTS

| | | | | |
|---|---|---|---|---|
| 2,878,118 | A * | 3/1959 | Rogers et al. | 162/82 |
| 5,281,306 | A | 1/1994 | Kakiuchi et al. | |
| 5,292,581 | A * | 3/1994 | Viazmensky et al. | 442/408 |
| 6,068,734 | A * | 5/2000 | Wallenius et al. | 162/141 |
| 6,074,523 | A * | 6/2000 | Mizobuchi et al. | 162/91 |
| 6,544,912 | B1 | 4/2003 | Tanio et al. | |
| 6,602,386 | B1 * | 8/2003 | Takeuchi et al. | 162/115 |
| 6,808,598 | B1 * | 10/2004 | Takeuchi et al. | 162/115 |
| 7,241,711 | B2 * | 7/2007 | Takai et al. | 442/414 |
| 7,250,382 | B2 * | 7/2007 | Takai et al. | 442/414 |
| 2003/0178166 | A1 | 9/2003 | Takeuchi et al. | |

FOREIGN PATENT DOCUMENTS

| | | | |
|---|---|---|---|
| EP | 1302146 | A2 | 4/2003 |
| EP | 1302146 | A3 | 7/2003 |
| JP | 3292924 | A | 12/1991 |
| JP | 7024636 | B | 3/1995 |
| JP | 9228214 | A | 9/1997 |
| JP | 2001172850 | A | 6/2001 |
| JP | 2001288658 | A | 10/2001 |

OTHER PUBLICATIONS

Široky et al, "Alkali Treatments of Woven Lyocell Fabrics", Woven Fabrics, Prof. Han-Yong Jeon (Ed.), [online], 2012, retrieved from the Internet, [retrieved Oct. 22, 2012]. <URL: http://www.intechopen.com/books/woven-fabrics/alkali-treatments-of-woven-lyocell-fabrics>.*

International Search Report for PCT/JP2010/060005 dated Jul. 6, 2010.

Supplementary European Search Report for EP 10786264 issued Feb. 19, 2013.

* cited by examiner

*Primary Examiner* — Joseph S Del Sole

*Assistant Examiner* — Dennis Cordray

(74) *Attorney, Agent, or Firm* — Lowe Hauptman & Ham, LLP

(57) ABSTRACT

To provide a water disintegratable fibrous sheet with high water disintegratability and wet strength, that can be used as a cleaning sheet. A prescribed water disintegratable fibrous sheet comprising 30-50% by mass of unbeaten pulp (a) with a beating degree of 700 cc or greater; 20-40% by mass of beaten pulp (b) with a beating degree of 400-700 cc; 15-45% by mass of regenerated cellulose (c) with a beating degree of 700 cc or greater; and 2-15% by mass of fibrillated purified cellulose (d) with a beating degree of 0-400 cc.

8 Claims, No Drawings

WATER DISINTEGRATABLE FIBROUS SHEET

RELATED APPLICATIONS

The present application is a National Phase of International Application Number PCT/JP2010/060005, filed Jun. 8, 2010, and claims priority from Japanese Application Number 2009-140474, filed Jun. 11, 2009.

TECHNICAL FIELD

The present invention relates to a water disintegratable fibrous sheet that can be easily dispersed by a water stream. In particular, the invention relates to a water disintegratable fibrous sheet with excellent water disintegratability and wet strength.

BACKGROUND ART

Cleaning sheets made from paper, nonwoven fabrics and the like are used to wipe human skin on the buttocks, for example, or to clean toilet areas. Such cleaning sheets must have a certain degree of water disintegratability so that they can be flushed through the toilet for disposal after use. This is because when a low-water disintegratable cleaning sheet or the like is flushed and disposed of through the toilet, it can potentially clog waste water pipes or require greater time for dispersing in clarification tanks.

The cleaning sheets described above are also often packaged and sold in pre-moistened form with cleaning chemicals and the like, from the viewpoint of convenience and working efficiency. Such cleaning sheets must therefore have sufficient wet strength in order to withstand removal and wiping operations in a moistened state produced by impregnation with cleaning chemicals or the like.

In other words, such cleaning sheets must have water disintegratability and wet strength properties that at first appear to be incompatible.

In order to solve this problem, PTL1, for example, discloses a water disintegratable cleaning article comprising a carboxyl group-containing water-soluble binder, a metal ion and an organic solvent. However, safety is an issue because of the skin irritability of the metal ion and organic solvent used in the water disintegratable cleaning article.

PTL2 discloses a water disintegratable cleaning article obtained by impregnating polyvinyl alcohol-containing fibers with a boric acid aqueous solution. However, polyvinyl alcohol is poorly heat-resistant, and the wet strength of the water disintegratable cleaning article is reduced at above 40° C.

PTL3, on the other hand, discloses a water-collapsible nonwoven fabric with a wet strength of 100-800 gf/25 mm as measured according to JIS P 8135, which is obtained by tangling with high-pressure water jet flow treatment following blending of pulp with fiber having an average fiber length of 4-20 mm. The fabric has a high-bulk feel since it is a nonwoven fabric with entangled fibers. However, because fibers with a long average fiber length become entangled by high-pressure water jet treatment, resulting in relatively high wet strength in the nonwoven fabric, it has been difficult to achieve both strength and water disintegratability.

In order to solve the problems described above, the present applicants have previously disclosed, in PTL4 and PTL5, water disintegratable fibrous sheets containing fibrillated rayon composed of main bodies with prescribed fiber lengths and microfibers that extend from the main bodies. The water disintegratable fibrous sheets exhibit both a certain degree of water disintegratability and wet strength, but the technical field has a demand for water disintegratable fibrous sheets with even higher wet strength and/or water disintegratability.

Citation List

Patent Literature

[PTL1] Japanese Examined Patent Publication No. H07-24636

[PTL2] Japanese Unexamined Patent Publication No. H03-292924

[PTL3] Japanese Unexamined Patent Publication No. H09-228214

[PTL4] Japanese Unexamined Patent Publication No. 2001-172850

[PTL5] Japanese Unexamined Patent Publication No. 2001-288658

SUMMARY OF INVENTION

Technical Problem

It is an object of the present invention to provide a water disintegratable fibrous sheet having comparable water disintegratability and high wet strength compared to conventional water disintegratable fibrous sheets containing fibrillated rayon, so that the water disintegratable fibrous sheet can be used not only for the aforementioned cleaning sheets but also for water disintegratable absorbent articles such as sanitary napkins, panty liners, disposable diapers and the like.

Solution to Problems

As a result of diligent research directed toward solving the problems described above, the present inventors have found that the problems can be solved by a water disintegratable fibrous sheet comprising 30-50% by mass of unbeaten pulp (a) with a beating degree of 700 cc or greater; 20-40% by mass of beaten pulp (b) with a beating degree of 400-650 cc; 15-45% by mass of regenerated cellulose (c) with a beating degree of 700 cc or greater; and 2-15% by mass of fibrillated purified cellulose (d) with a beating degree of 0-400 cc; wherein the beaten pulp (b) and fibrillated purified cellulose (d) each comprise main bodies and microfiber sections extending from the main bodies, the fiber lengths of the main bodies of the fibrillated purified cellulose (d) at the peak of the weight-weighted average fiber length distribution are in the range of 1-7 mm, and the microfibers of the beaten pulp (b) and the fibrillated purified cellulose (d) are each entangled with the other fibers. The invention has been completed upon this finding.

Specifically, the present invention relates to the following embodiments.

Embodiment 1

A water disintegratable fibrous sheet, comprising 30-50% by mass of unbeaten pulp (a) with a beating degree of 700 cc or greater;

20-40% by mass of beaten pulp (b) with a beating degree of 400-650 cc;

15-45% by mass of regenerated cellulose (c) with a beating degree of 700 cc or greater and 2-15% by mass of fibrillated purified cellulose (d) with a beating degree of 0-400 cc;

wherein the water disintegratable fibrous sheet is characterized in that the beaten pulp (b) and fibrillated purified cellulose (d) each comprise main bodies and microfiber sections extending from the main bodies, the fiber lengths of the main bodies of the fibrillated purified cellulose (d) at the peak of the weight-weighted average fiber length distribution are in the range of 1-7 mm, and the microfibers of the beaten pulp (b) and the fibrillated purified cellulose (d) are each entangled with the other fibers.

Embodiment 2

The water disintegratable fibrous sheet according to embodiment 1, wherein the microfiber sections of the fibrillated purified cellulose (d) constitute 0.1-65% by mass of the dry mass of the fibrillated purified cellulose (d).

Embodiment 3

The water disintegratable fibrous sheet according to embodiment 1 or 2, wherein the average fiber length of the regenerated cellulose (c) is in the range of 3-13 mm.

Embodiment 4

The water disintegratable fibrous sheet according to any one of embodiments 1-3, wherein the regenerated cellulose (c) contains regenerated cellulose (c-1) with an average fiber length in a range of at least 3 mm and no greater than 8 mm and regenerated cellulose (c-2) with an average fiber length in a range of greater than 8 mm and no greater than 13 mm.

Embodiment 5

The water disintegratable fibrous sheet according to any one of embodiments 1-4, wherein the microfibers of the beaten pulp (b) and/or fibrillated purified cellulose (d) are hydrogen bonded with the other fibers.

Embodiment 6

The water disintegratable fibrous sheet according, to any one of embodiments 1-5, which is a nonwoven fabric that has been water jet-treated.

Embodiment 7

The water disintegratable fibrous sheet according to any one of embodiments 1-6, which has a water disintegratability of no greater than 600 seconds.

Embodiment 8

The water disintegratable fibrous sheet according to any one of embodiments 1-7, wherein the MD wet strength is at least 3 N/25 mm and the CD wet strength is a value of at least 70% of the MD wet strength.

Advantageous Effects of Invention

Since the water disintegratable fibrous sheet of the invention has high strength, it is resistant to tearing when removed from plastic containers or bags and used for wiping, regardless of whether it is used in a dry state or a wet state.

Also, since the water disintegratable fibrous sheet of the invention, despite its high wet strength, easily disperses when immersed in ample water after use, it can be flushed and disposed of through toilets and the like.

Moreover, the water disintegratable fibrous sheet of the invention is composed of materials that are safe for the human body, and can therefore be used in direct contact with the body.

DESCRIPTION OF EMBODIMENTS

The water disintegratable fibrous sheet of the invention will now be explained in detail.

[Unbeaten Pulp (a)]

The unbeaten pulp (a) is the component that imparts bulk to the water disintegratable fibrous sheet of the invention. As unbeaten pulp (a) there may be mentioned wood pulp such as softwood pulp and hardwood pulp, or Manila hemp, linter pulp, bamboo pulp, kenaf and the like. The unbeaten pulp (a) is preferably softwood pulp, that readily exhibits both strength and water disintegratability. Bleached softwood kraft pulp may be mentioned as softwood pulp.

The unbeaten pulp (a) used has a beating degree of 700 cc or greater. As used herein, "beating degree" refers to the CSF (Canadian Standard Freeness) value, and it may be measured according to the Canadian Standard Freeness Test Method of JIS P 8121.

The average fiber length of the unbeaten pulp (a) is not particularly restricted, but for most purposes it is preferably 2-4 mm from the viewpoint of economy and productivity.

As used herein, the term "average" in the expression "average fiber length" refers to the weighted average.

[Beaten Pulp (b)]

The beaten pulp (b) is the component that imparts strength, i.e. dry strength and wet strength, to the water disintegratable fibrous sheet of the invention. As materials for the beaten pulp (b) there may be mentioned, as for the unbeaten pulp (a), wood pulp such as softwood pulp and hardwood pulp, or Manila hemp, linter pulp, bamboo pulp, kenaf and the like. The unbeaten pulp (a) is preferably softwood pulp, that readily exhibits both strength and water disintegratability. Bleached softwood kraft pulp may be mentioned as softwood pulp. The beaten pulp (b) may be the same material as the unbeaten pulp (a), or a different material.

The beaten pulp (b) is pulp obtained by beating the aforementioned material by a method such as free beating or wet beating, and it has main bodies and microfiber sections extending from the main bodies. The beating (fibrillation) will be described in detail under [Fibrillated purified cellulose (d)] below.

The beaten pulp (b) has a beating degree of 400-650 cc, and preferably a beating degree of 400-600 cc. If the beating degree is less than 400 cc, the water disintegratable fibrous sheet of the invention will be paper-like with a reduced hand quality, while if the beating degree is greater than 650 cc, it will not be possible to obtain the necessary wet strength.

The fiber lengths of the main bodies of the beaten pulp (b) at the peak of the weight-weighted average fiber length distribution are not particularly restricted in the range of beating degree of 400-650 cc, but they are preferably 0.3-5.0 mm, more preferably 0.5-3.0 mm and even more preferably 0.7-2.0 mm.

[Regenerated Cellulose (c)]

The regenerated cellulose (c) is the component that imparts a hand quality to and increases the wet strength of the water disintegratable fibrous sheet of the invention. Viscose rayon and copper-ammonia rayon may be mentioned as regenerated cellulose (c).

The regenerated cellulose (c) may be a single type of fiber alone, or a combination of two or more different types of fiber. When a single type of fiber is used alone, the average fiber length of the regenerated cellulose (c) is preferably in the range of 3-13 mm and more preferably in the range of 5-11 mm. A longer average fiber length will tend to increase the strength, and especially the wet strength, of the water disintegratable fibrous sheet, but will also tend to impair the water disintegratability.

When two or more different types of fiber are used, such as fiber with an average fiber length in the range of at least 3 mm and no greater than 8 mm and fiber with said range of greater than 8 mm and no greater than 13 mm, it is possible to obtain a water disintegratable fibrous sheet with both excellent wet strength and water disintegratability, which maintains the strength of the water disintegratable fibrous sheet of the invention by the fibers with long average fiber lengths while increasing the strength and keeping a constant level of water disintegratability by the fibers with short average fiber lengths. By thus using fibers with different average fiber lengths, it is possible provide both water disintegratability and wet strength to the water disintegratable fibrous sheet of the invention.

The fineness of the regenerated cellulose (c) is preferably 0.6-1.7 dtex and more preferably 0.8-1.4 dtex. If the fineness is less than 0.6, the production cost of the regenerated cellulose (c) will be increased and the spinning quality will tend to be unstable, while if the fineness is greater than 1.7, it will be more difficult to cause fiber tangling and sufficient strength may not be achieved.

[Fibrillated Purified Cellulose (d)]

The fibrillated purified cellulose (d) is a component that imparts both water disintegratability and wet strength to the water disintegratable fibrous sheet of the invention. The surfaces of the fibrillated purified cellulose (d) are finely fibrillated, or in other words, it has microfibers with a submicron thickness separating out from the surfaces of the main bodies of the fiber (fibrillated purified cellulose (d)), with the microfibers extending from the surfaces of the main bodies of the fiber. Since the fibers of the fibrillated purified cellulose (d) have fibrillated surfaces, the surface structure is different from ordinary purified cellulose fiber having smooth surfaces.

As used herein, the microfiber sections of the fibrillated purified cellulose (d) are the one or more sections of submicron thickness that separate from the fiber surfaces of the fibrillated purified cellulose (d) and are connected to the main bodies of the fibrillated purified cellulose (d).

The fibrillated purified cellulose (d) may be obtained by, for example, wet beating, such as dispersing purified cellulose in water and applying mechanical force. Examples of specific production methods include placing the purified cellulose in a mixer and vigorously agitating it in water, and beating or wet beating it using a pulper, refiner or beater.

As used herein, the term "wet beating" refers to beating for the purpose of fibrillating, or napping, the surfaces of fiber without altering the fiber lengths, but it also includes wet beating in such a manner that the fiber lengths are slightly shortened, so long as the fiber surfaces are fibrillated.

Several means exist for identifying the fibrillated purified cellulose (d). One such means is by the weight-weighted average fiber length distribution (weight distribution) of the main bodies and microfibers of the fibrillated purified cellulose (d). Since the length distribution of the microfibers appears in a shorter region than the fiber length distribution for the main bodies, it is possible to find the weight-weighted average fiber length distribution for the main bodies and microfiber sections by determining the fiber length distribution for the entire fibrillated purified cellulose (d). Another means for identifying the fibrillated purified cellulose (d) is based on the beating degree of the fibrillated purified cellulose (d).

The weight-weighted average fiber length distribution can be measured using a Kajaani fiber length analyzer by Metso Automation.

The fibrillated purified cellulose (d) can be identified as cellulose having a peak for the fiber lengths of the main bodies of the fibrillated purified cellulose (d) and a peak for the fiber lengths of microfibers as the fibrillated sections, as described in Japanese Unexamined Patent Publication No. 2001-288658.

The fiber length at the peak of the weight-weighted average fiber length distribution for the main bodies of the fibrillated purified cellulose (d) is in the range of 1-7 mm, and preferably in the range of 2-6 mm.

If the fiber length at the peak of the weight-weighted average fiber length distribution for the main bodies of the fibrillated purified cellulose (d) is less than 1 mm, it will be difficult to obtain sufficient entangled strength and the wet strength of the water disintegratable fibrous sheet will be reduced. On the other hand, a fiber length of greater than 7 mm will cause tangling not only of the microfibers but also between the main bodies during the water jet treatment, or the main bodies may become entangled with other fibers, thus lowering the water disintegratability of the water disintegratable fibrous sheet of the invention.

The microfibers with lengths of no greater than 1 mm extending from each of the main bodies of the fibrillated purified cellulose (d) preferably constitute 0.1-65% by mass of the dry mass of the fibrillated purified cellulose (d). If the amount of microfibers is below this range the tangling may be insufficient and the strength lowered, while if it is above this range the lengths of the main bodies will be shortened, resulting in free beating instead of wet beating.

The beating degree of the fibrillated purified cellulose (d) is 0-400 cc, preferably 100-300 cc and more preferably 150-250 cc. Continued beating (reducing the numerical value of the beating degree) can increase the wet strength of the water disintegratable fibrous sheet, but since continued beating will also harden the water disintegratable fibrous sheet and render it less water disintegratable, the aforementioned range is preferred.

The beating degree of the fibrillated purified cellulose (d) can be adjusted by the treatment time with the mixer, pulper or refiner, and by the beating method. With continued beating (a lower numerical value for the beating degree), the proportion of the weight-weighted average fiber length distribution of the short fibers, as a result of the generated microfibers, increases.

The fineness of the fibrillated purified cellulose (d) is preferably about 1.1 to about 7.7 dtex, and more preferably 1.1-1.9 dtex. If the fineness is less than 1.1 dtex, the main bodies of the fibrillated purified cellulose (d) will become excessively entangled, tending to reduce the water disintegratability, while a fineness of greater than 7.7 dtex will tend to lower the texture and productivity.

As purified celluloses there may be mentioned fiber formed by dissolving pulp in an aqueous solution of N-methylmorpholine N-oxide to produce a spinning stock solution (dope) and extruding into a dilute solution of N-methylmorpholine N-oxide, and examples of such celluloses include Tencel™ and Lyocell™.

[Water Disintegratable Fibrous Sheet]

The water disintegratable fibrous sheet of the invention includes the unbeaten pulp (a), beaten pulp (b), regenerated cellulose (c) and fibrillated purified cellulose (d).

The amounts of unbeaten pulp (a), beaten pulp (b), regenerated cellulose (c) and fibrillated purified cellulose (d) are 30-50% by mass, 20-40% by mass, 15-45% by mass and 2-15% by mass, and preferably 35-45% by mass, 15-25% by mass, 30-40% by mass and 3-10% by mass, respectively, based on their total.

The unbeaten pulp (a) is the component that imparts bulk to the water disintegratable fibrous sheet of the invention. The beaten pulp (b) is the component that imparts strength, i.e. dry strength and wet strength, to the water disintegratable fibrous sheet of the invention. By replacing the unbeaten pulp (a) with the beaten pulp (b) it is possible to increase the wet strength and dry strength of the water disintegratable fibrous sheet, but an excessive amount of beaten pulp (b) will lower the bulk and tend to produce a paper-like quality.

The regenerated cellulose (c) is the component that imparts a hand quality to and increases the wet strength of the water disintegratable fibrous sheet of the invention, but an excessive amount of regenerated cellulose (c) will tend to be economically disadvantageous.

The fibrillated purified cellulose (d) is a component that imparts both water disintegratability and wet strength to the water disintegratable fibrous sheet of the invention. However, increasing the amount of the fibrillated purified cellulose (d) will tend to be economically disadvantageous.

The total amount of the unbeaten pulp (a) and beaten pulp (b) is preferably 50-70% by mass and more preferably 55-65% by mass based on the total of the unbeaten pulp (a), beaten pulp (b), regenerated cellulose (c) and fibrillated purified cellulose (d).

The water disintegratable fibrous sheet of the invention is obtained by forming the aforementioned components (a)-(d) into a sheet. As examples of water disintegratable fibrous sheets of the invention, there may be mentioned the fiber web obtained by paper-making the aforementioned components (a)-(d), and the nonwoven fabric obtained by further water jet-treating this fiber web.

The basis weight of the water disintegratable fibrous sheet of the invention is preferably 20-100 g/m$^2$, considering use in a moistened state and use as a surface material for absorbent articles. If the basis weight is below this range it will be difficult to obtain the necessary wet strength, and if the basis weight is above this range a lack of flexibility may result. Particularly for use in contact with human skin, the basis weight of the water disintegratable fibrous sheet of the invention is preferably 30-70 g/m$^2$ from the viewpoint of wet strength and softness. The water disintegratable fibrous sheet of the invention can also be formed by laminating together 15-25 g/m$^2$ fiber webs.

The water disintegratable fibrous sheet of the invention can be used in the form of a paper sheet obtained by a wet laid paper making process or the like.

Drying the water disintegratable fibrous sheet of the invention will increase the strength of the sheet by hydrogen bonding by OH groups on the surface of the beaten pulp (b) and/or fibrillated purified cellulose (d). If the proportion of fibrillation, i.e. the proportion of microfibers is increased, the surface area of the fibers will be greater, thus increasing the bonding strength by hydrogen bonding. Thus, the hydrogen bonding force can contribute to high water disintegratability and strength, and particularly dry strength.

In order to increase the wet strength, it is preferred to water jet-treat the fiber web after the fiber web has been formed by a wet laid paper making process, for example. Water jet treatment may be carried out using a high-pressure water jet flow treatment apparatus that is commonly used in the technical field. Water jet treatment will cause the microfibers extending from the beaten pulp (b) and fibrillated purified cellulose (d) to entangle with the other fibers, resulting in increased bonding strength between the fibers and greater dry strength due to the hydrogen bonding force of the microfibers. Moreover, tangling can maintain high wet strength in a wet state even if the hydrogen bonds are broken.

Incidentally, the tangling in the water disintegratable fibrous sheet of the invention differs from tangling of fibers in ordinary spunlace nonwoven fabrics and the like where the fibers themselves are entangled, in that the microfibers on the surface of the beaten pulp (b) and fibrillated purified cellulose (d) are entangled with the fibers.

In the water jet treatment, usually the fiber web is placed on a continuously moving mesh-like conveyor belt and a high-pressure water jet is shot from the surface of the fiber web to the back side. In such water jet treatment, the properties of the obtained water disintegratable fibrous sheet can be adjusted by varying the basis weight of the fiber web, the hole size of the nozzle, the hole number of the nozzle, the through-speed during the fiber web treatment (treatment speed) and the mesh. After the fiber web has been formed during production of the water disintegratable fibrous sheet, the fiber web is preferably water jet-treated without being dried, for convenience in processing. However, the fiber web may also be dried first and then water jet-treated.

The water disintegratable fibrous sheet of the invention preferably has an MD wet strength of at least 3 N/25 mm and a CD wet strength value of at least 70% of the MD wet strength. If these values for the water disintegratable fibrous sheet of the invention are within these ranges, the resulting sheet will be resistant to tearing during removal and wiping operations.

As used herein, the term "dry strength" refers to the breaking strength in a dry state, and as a general rule, the breaking strength is measured according to JIS P 8135 and JIS P 8113, as the breaking tensile force (N) after a fibrous sheet cut to 25 mm width×150 mm length is allowed to stand for 24 hours under conditions with an atmosphere of 20° C., 65% relative humidity for drying, and the dried fibrous sheet is measured with a Tensilon tester at a chuck spacing of 100 mm and a pull rate of 100 mm/min.

As used herein, the term "wet strength" refers to the breaking strength in a wet state, where the breaking strength is measured as the breaking tensile force (N) in the same manner, when the dried fibrous sheet mentioned above is impregnated with a 2.5-fold amount of water with respect to the weight.

As used herein, the term "MD" means the machine direction during production, and the term "CD" means the cross machine direction perpendicular to the machine direction. The MD is also referred to as the longitudinal direction of the water disintegratable fibrous sheet, and the CD is also referred to as the transverse direction of the water disintegratable fibrous sheet.

The water disintegratability of the water disintegratable fibrous sheet of the invention may differ depending on country-specific drainage equipment, conditions for treatment of sewage, and the like, but for most purposes the value measured according to the toilet paper disintegratability test of JIS P 4501, described hereunder, is preferably no greater than 600 seconds.

The toilet paper disintegratability test of JIS P 4501 is as follows.

The water disintegratable fibrous sheet is cut to a 10 cm length×10 cm width and placed in a 300 mL-volume beaker containing 300 mL of ion-exchanged water, and agitated using a rotor. The rotational speed is 600 rpm.

The dispersed state of the water disintegratable fibrous sheet is periodically observed visually and the time until the water disintegratable fibrous sheet becomes finely dispersed is measured.

However, the aforementioned test method gives an approximate measure of the water disintegratability, and water disintegratable fibrous sheets having essentially the same water disintegratability are encompassed within the scope of the invention.

The preferred water disintegratability and wet strength described above can be obtained for the water disintegratable fibrous sheet of the invention by varying the type of fiber, the mixing proportion and the basis weight, as well as the water jet treatment conditions. For example, when numerous fibers with long fiber lengths are at the peak of the average fiber length or weight-weighted average fiber length distribution, it is possible to form a sheet with excellent water disintegratability and wet strength by means such as reducing the basis weight of the fibrous sheet or reducing the water jet treatment energy.

The water disintegratable fibrous sheet of the invention exhibits excellent water disintegratability and wet strength even without containing a binder. Depending on the use, however, a binder may also be added to the water disintegratable fibrous sheet of the invention in order to further increase the wet strength of the water disintegratable fibrous sheet of the invention. Such a binder is more preferably one that dissolves or swells when in contact with an abundance of water, to eliminate the bonds between the fibers.

As examples of binders there may be mentioned alkylcelluloses such as carboxymethylcellulose, methylcellulose, ethylcellulose and benzylcellulose, as well as polyvinyl alcohol, modified polyvinyl alcohols containing prescribed amounts of sulfonic acid or carboxyl groups, and polyamide-epichlorhydrin. Because the water disintegratable fibrous sheet of the invention has excellent water disintegratability and wet strength, a smaller amount of binder may be added than according to the prior art, and sufficient wet strength can be obtained, for example, with approximately 2 g of water-soluble or water-swelling binder with respect to 100 g of fiber. With a water-insoluble binder, sufficient wet strength can be obtained even with less than 0.2 g. Even when the aforementioned binder is used, therefore, the safety of the water disintegratable fibrous sheet of the invention is not significantly reduced. The water-soluble binder may be coated with a silk screen or the like. When the binder is water-swellable or water-insoluble, the binder may be mixed during production of the fiber web.

When a binder is used, addition of an electrolyte such as a water-soluble inorganic salt and/or organic salt to the nonwoven fabric can further increase the wet strength of the water disintegratable fibrous sheet. As inorganic salts there may be mentioned sodium sulfate, potassium sulfate, zinc sulfate, zinc nitrate, aluminum potassium sulfate, sodium chloride, aluminum sulfate, magnesium sulfate, potassium chloride, sodium carbonate, sodium hydrogencarbonate, ammonium carbonate and the like, and as organic salts there may be mentioned sodium pyrrolidone carboxylate, sodium citrate, potassium citrate, sodium tartrate, potassium tartrate, sodium lactate, sodium succinate, calcium pantothenate, calcium lactate, sodium lauryl sulfate and the like. When an alkylcellulose is used as the binder, a monovalent salt is preferred. A monovalent salt is also preferred when polyvinyl alcohol or modified polyvinyl alcohol is used as the binder.

When an alkylcellulose is used as the binder, the strength of the water disintegratable fibrous sheet can be increased by, for example, adding a copolymer of a polymerizable acid anhydride such as a (meth)acrylate/maleic acid-based resin or (meth)acrylate/fumaric acid-based resin, with another compound. The copolymer is preferably water-soluble, having been saponified by the action of sodium hydroxide for conversion to a partial carboxylic acid sodium salt. Further addition of an amino acid derivative such as trimethylglycine is preferred from the viewpoint of strength.

In addition, additives commonly employed in water disintegratable fibrous sheets, such as surfactants, microbicides, preservatives, deodorants, humectants, alcohols such as ethanol and polyhydric alcohols such as glycerin, may also be added to the water disintegratable fibrous sheet of the invention in ranges that do not interfere with the effect of the invention.

The water disintegratable fibrous sheet of the invention has excellent water disintegratability and wet strength, and can therefore be used as a wet tissue for use on human skin such as wiping of the buttocks, or as a cleaning sheet for toilet areas. When the water disintegratable fibrous sheet of the invention is packaged and marketed as a product prewetted with a cleaning solution or the like, it is preferably packaged in a sealed fashion to prevent drying of the fibrous sheet. Alternatively, the water disintegratable fibrous sheet of the invention may be marketed in a dry form. For example, the water disintegratable fibrous sheet of the invention may be of such a type that the product purchaser impregnates the water disintegratable fibrous sheet with an aqueous chemical at the time of use.

The fibrous sheet of the invention may also be subjected to embossing treatment. Addition of a small amount of water, followed by heating and embossing, will strengthen the hydrogen bonding between the fibrillated purified cellulose (d) or between the fibrillated purified cellulose (d) and other fiber, thus producing a fibrous sheet with high dry strength. The water disintegratable fibrous sheet of the invention can also be a sheet with a multilayer structure having a high content of fibrillated purified cellulose (d) on the surface layer.

Examples

The present invention will now be explained in greater detail by the following examples, with the understanding that the invention is in no way restricted to the examples.

Production Example 1

Bleached softwood kraft pulp (NBKP, Canadian Standard Freeness (CSF)=740 cc) was put through a mixer to obtain beaten pulp (b) with a beating degree of 600 cc. Tencel (trade name of Lenzing (Austria), average fiber length: 3 mm, 1.7 dtex) was subjected to wet beating with a batch disintegrator (pulper by Aikawa Iron Works Co.) and a continuous disintegrator (B-type Top Finer by Aikawa Iron Works Co.), to obtain fibrillated purified cellulose (d) (fiber length at peak of weight-weighted average fiber length distribution: 3 mm, microfiber section: 1.54% by mass, beating degree: 212 cc). As the unbeaten pulp (a) there was prepared bleached softwood kraft pulp (NBKP, Canadian Standard Freeness (CSF)=740 cc), and as the regenerated cellulose (c)-1 there was prepared viscose rayon (product of OmiKenshi Co., Ltd., average fiber length: 7 mm, 1.1 dtex).

Example 1

Unbeaten Pulp (a) and Beaten Pulp (b) Contents

The unbeaten pulp (a), beaten pulp (b), regenerated cellulose (c)-1 and fibrillated purified cellulose (d) were combined as shown in Table 1 and subjected to wet laid paper making process with a square type sheet machine to obtain a fiber web. The fiber web was placed on a 100 mesh plastic net, and the fiber web was water jet-treated (treatment pressure: 80 kg/cm$^2$, running speed: 30 m/min) from top surface using two nozzles (nozzle hole diameter: 92μ, 0.5 mm pitch) while suctioning the water from the bottom by suction force, and then dried with a rotary dryer to obtain a water disintegratable fibrous sheet.

The water disintegratability, the dry and wet strength and the stretch at break of the obtained water disintegratable fibrous sheet were evaluated by the following test methods.

[Water Disintegratability Test]

The water disintegratability was evaluated according to the toilet paper disintegratability test of JIS P 4501, as described above.

[Dry and Wet Strength and Elongation at Break]

The dry and wet strengths and elongations at break of water disintegratable fibrous sheets No. 1-No. 7 were measured according to the test methods described above. The dry and wet measurements were both conducted in both the MD and CD directions. The results are summarized in Table 1.

TABLE 1

Unbeaten pulp (a) and beaten pulp (b) contents

| | | Water disintegratable fibrous sheet | | | | | | |
|---|---|---|---|---|---|---|---|---|
| | | No. 1 | No. 2 | No. 3 | No. 4 | No. 5 | No. 6 | No. 7 |
| Unbeaten pulp (a) | parts by mass | 70 | 60 | 50 | 40 | 30 | 10 | 0 |
| Beaten pulp (b) | parts by mass | 0 | 10 | 20 | 30 | 40 | 60 | 70 |
| Regenerated cellulose (c)-1 | parts by mass | 25 | 25 | 25 | 25 | 25 | 25 | 25 |
| Fibrillated purified cellulose (d) | parts by mass | 5 | 5 | 5 | 5 | 5 | 5 | 5 |
| Basis weight | g/m$^2$ | 59.3 | 59.1 | 58.5 | 59.4 | 58.9 | 59.4 | 60.9 |
| Thickness | mm | 0.43 | 0.40 | 0.38 | 0.37 | 0.36 | 0.35 | 0.34 |
| Density | g/cm$^3$ | 0.138 | 0.148 | 0.154 | 0.161 | 0.164 | 0.170 | 0.179 |
| Dry strength | MD | 13.8 | 18.1 | 20.7 | 22.0 | 23.7 | 25.2 | 25.7 |
| (N/25 mm) | CD | 7.5 | 9.1 | 9.5 | 9.6 | 9.9 | 10.5 | 10.8 |
| Dry elongation | MD | 8.7 | 4.0 | 3.8 | 3.4 | 3.3 | 2.2 | 2.2 |
| at break (%) | CD | 19.0 | 16.7 | 16.5 | 15.6 | 14.7 | 12.5 | 11.1 |
| Wet strength | MD | 2.0 | 2.8 | 3.2 | 3.4 | 3.1 | 2.8 | 2.7 |
| (N/25 mm) | CD | 1.7 | 2.3 | 2.5 | 2.7 | 2.3 | 2.2 | 1.9 |
| Wet elongation | MD | 25.1 | 28.8 | 32.8 | 31.6 | 29.4 | 27.6 | 22.2 |
| at break (%) | CD | 30.7 | 34.1 | 36.8 | 38.4 | 37.8 | 38.8 | 40.1 |
| Water disintegratability | (sec) | 55 | 174 | 228 | 208 | 224 | 231 | 233 |

It was demonstrated by the water disintegratable fibrous sheets No. 1-No. 7 that wet strength can be increased while maintaining water disintegratability, by replacing a portion of unbeaten pulp (a) with beaten pulp (b). It was also shown, however, that excessive replacement with beaten pulp (b) lowers the wet strength of the water disintegratable fibrous sheet.

An excessively high beaten pulp (b) content will lower the water filtering property during formation of the fiber web and increase the difference in the aspect ratio of the resulting fiber web, and therefore of the water disintegratable fibrous sheet, thus tending to create a poor texture.

Example 2

Regenerated Cellulose (c) and Fibrillated Purified Cellulose (d) Contents

Water disintegratable fibrous sheets No. 8-No. 10 were obtained in the same manner as Example 1, except for using the unbeaten pulp (a), beaten pulp (b), regenerated cellulose (c)-1, regenerated cellulose (c)-2 (viscose rayon, product of OmiKenshi Co., Ltd., average fiber length: 10 mm, 1.1 dtex) and fibrillated purified cellulose (d) shown in Table 2.

The water disintegratability, the dry and wet strengths and the elongations at break of the obtained water disintegratable fibrous sheets were evaluated in the same manner as Example 1. The unbeaten pulp (a), beaten pulp (b), regenerated cellulose (c)-1 and fibrillated purified cellulose (d) were the same as used in Example 1. The results are summarized in Table 2.

TABLE 2

Regenerated cellulose (c) and fibrillated purified cellulose (d) contents

| | | Water disintegratable fibrous sheet | | |
|---|---|---|---|---|
| | | No. 8 | No. 9 | No. 10 |
| Unbeaten pulp (a) | parts by mass | 40 | 35 | 40 |
| Beaten pulp (b) | parts by mass | 20 | 20 | 20 |

TABLE 2-continued

Regenerated cellulose (c) and fibrillated purified cellulose (d) contents

| | | Water disintegratable fibrous sheet | | |
|---|---|---|---|---|
| | | No. 8 | No. 9 | No. 10 |
| Regenerated cellulose (c)-1 | parts by mass | 35 | 35 | 25 |

TABLE 2-continued

| Regenerated cellulose (c) and fibrillated purified cellulose (d) contents | | | | |
|---|---|---|---|---|
| | | Water disintegratable fibrous sheet | | |
| | | No. 8 | No. 9 | No. 10 |
| Regenerated cellulose (c)-2 | parts by mass | 0 | 0 | 10 |
| Fibrillated purified cellulose (d) | parts by mass | 5 | 10 | 5 |
| Basis weight | $g/m^2$ | 62.4 | 61.8 | 60.7 |
| Thickness | mm | 0.42 | 0.40 | 0.40 |
| Density | $g/cm^3$ | 0.149 | 0.155 | 0.151 |
| Dry strength (N/25 mm) | MD | 18.7 | 20.1 | 19.3 |
| | CD | 10.2 | 13.7 | 9.3 |
| Dry elongation at break (%) | MD | 3.3 | 3.9 | 5.0 |
| | CD | 13.7 | 18.8 | 18.8 |
| Wet strength (N/25 mm) | MD | 4.6 | 5.7 | 5.2 |
| | CD | 3.9 | 4.5 | 4.4 |
| Wet elongation at break (%) | MD | 31.7 | 32.1 | 31.0 |
| | CD | 41.6 | 46.7 | 42.0 |
| Water disintegratability | (sec) | 253 | 263 | 485 |

Upon comparing the water disintegratable fibrous sheets No. 3 and No. 4 of Example 1 and the water disintegratable fibrous sheet No. 8, it is seen that the wet strength is significantly increased by replacing the unbeaten pulp (a) or beaten pulp (b) with the regenerated cellulose (c)-1.

Also, by comparing the water disintegratable fibrous sheets No. 8 and No. 9, it is seen that the wet strength is significantly increased by increasing the fibrillated purified cellulose (d) content.

Finally, by comparing the water disintegratable fibrous sheets No. 8 and No. 10, it is seen that the wet strength can be increased by using in combination two types of regenerated cellulose (c) with different average fiber lengths.

The invention claimed is:

1. A water disintegratable fibrous sheet, comprising 30-50% by mass of unbeaten pulp (a) with a beating degree of 700 cc or greater;

20-40% by mass of beaten pulp (b) with a beating degree of 400-650 cc;

15-45% by mass of regenerated cellulose (c) with a beating degree of 700 cc or greater and 2-15% by mass of fibrillated purified cellulose (d) with a beating degree of 0-400 cc;

wherein the beaten pulp (b) and fibrillated purified cellulose (d) each comprise main bodies and microfiber sections extending from the main bodies, the fiber lengths of the main bodies of the fibrillated purified cellulose (d) at the peak of the weight-weighted average fiber length distribution are in the range of 1-7 mm, the microfibers of the beaten pulp (b) and the fibrillated purified cellulose (d) are each entangled with the other fibers, the regenerated cellulose (c) is viscose rayon or copper-ammonia rayon, the fibrillated purified cellulose (d) is formed by dissolving pulp in an aqueous solution of N-methylmorpholine N-oxide to produce a spinning stock solution (dope) and extruding into a dilute solution of N-methylmorpholine N-oxide, and the microfiber sections of the fibrillated purified cellulose (d) constitute 0.1-65% by mass of the dry mass of the fibrillated purified cellulose (d).

2. The water disintegratable fibrous sheet according to claim 1, wherein an average fiber length of the regenerated cellulose (c) is in the range of 3-13 mm.

3. The water disintegratable fibrous sheet according to claim 1, wherein the regenerated cellulose (c) contains regenerated cellulose (c-1) with an average fiber length in a range of at least 3 mm and no greater than 8 mm and regenerated cellulose (c-2) with an average fiber length in a range of greater than 8 mm and no greater than 13 mm.

4. The water disintegratable fibrous sheet according to claim 1, wherein the microfibers of the beaten pulp (b) and/or fibrillated purified cellulose (d) are hydrogen bonded with the other fibers.

5. The water disintegratable fibrous sheet according to claim 1, which is a water jet-treated nonwoven fabric.

6. The water disintegratable fibrous sheet according to claim 1, which has a water disintegratability of no greater than 600 seconds.

7. The water disintegratable fibrous sheet according to claim 1, wherein a MD (machine direction) wet strength is at least 3 N/25 mm and a CD (cross direction) wet strength is a value of at least 70% of the MD wet strength.

8. The water disintegratable fibrous sheet according to claim 1, wherein the regenerated cellulose (c) has the beating degree greater than 700 cc.

* * * * *